US007137858B2

(12) United States Patent
Jang

(10) Patent No.: US 7,137,858 B2
(45) Date of Patent: Nov. 21, 2006

(54) PLASMA DISPLAY PANEL WITHOUT INJECTION TIP, AND METHOD OF MANUFACTURING THE SAME

(76) Inventor: Duk-Youn Jang, 89, Seongdae-ri, Miwon-myeon, Cheongwon-gun, Chungcheongbuk-do 363-874 (KR)

( * ) Notice: Subject to any disclaimer, the term of this patent is extended or adjusted under 35 U.S.C. 154(b) by 260 days.

(21) Appl. No.: 10/842,004

(22) Filed: May 6, 2004

(65) Prior Publication Data

US 2005/0191928 A1 Sep. 1, 2005

(30) Foreign Application Priority Data

Feb. 27, 2004 (KR) ..... 10-2004-0013408

(51) Int. Cl.
*H01J 9/26* (2006.01)
*H01J 9/32* (2006.01)
*H01J 9/24* (2006.01)

(52) U.S. Cl. ..... 445/25; 445/24; 313/493; 118/641

(58) Field of Classification Search ..... 445/24, 445/25

See application file for complete search history.

(56) References Cited

U.S. PATENT DOCUMENTS 4,703,574 A 11/1987 Garjian ..... 40/545
5,797,780 A * 8/1998 Peng ..... 445/25

FOREIGN PATENT DOCUMENTS

KR 10068169 7/2001

* cited by examiner

*Primary Examiner*—Mariceli Santiago
*Assistant Examiner*—Elizabeth Rielley
(74) *Attorney, Agent, or Firm*—Abelman, Frayne & Schwab

(57) ABSTRACT

The present invention provides a plasma display panel without any injection tip and a method of manufacturing the same. The plasma display panel without any injection tip has a structure capable of directly injecting gas for electric discharge into the plasma display panel through an injection hole of a lower glass substrate using a vacuum apparatus while manufacturing the plasma display panel, thus sealing the plasma display panel in the vacuum. Therefore, the plasma display panel without any injection tip reduces a thickness thereof, thus reducing a space required to install the plasma display panel. Furthermore, the plasma display panel without any injection tip avoids damages, caused by an injection tip of conventional plasma display panels, during a process of transporting or installing the plasma display panel.

3 Claims, 9 Drawing Sheets

FIGURE

PLASMA DISPLAY PANEL WITHOUT INJECTION TIP, AND METHOD OF MANUFACTURING THE SAME

BACKGROUND OF THE INVENTION

1. Field of the Invention

The present invention relates generally to plasma display panels without injection tips and methods of manufacturing the same, and more particularly, to a plasma display panel without any injection tip and a method of manufacturing the same, which has a structure capable of injecting gas into and sealing the thin plasma display panel, without using any injection tip, while manufacturing the thin plasma display panel, thus stably exhausting air from and injecting the gas into the plasma display panel, reducing a space required to install the plasma display panel in a frame of a neon sign, and avoiding damages, caused by the injection tip of a conventional plasma display panel, while carrying the plasma display panel.

2. Description of the Related Art

Generally, neon signs are light emitting devices to display letters or pictures (hereinafter, term "advertisement pattern" is used to include all of the designs, such as letters, logos and etc., for an advertisement) for the purpose of advertising.

In the conventional neon signs, a heated glass tube is deformed into a predetermined shape. Thereafter, electric-discharge gas, such as neon or etc., is injected into the glass tube, thus forming a desired advertisement pattern.

That is, the glass tube has been used to form the advertisement pattern, such as letters or marks to be advertised. However, the conventional glass tube is supported by a support frame in the neon signs. Therefore, the conventional neon sign using the glass tube is problematic in that its size is excessively increased.

In addition to the above-mentioned problem of increasing the size, the conventional neon sign is easily broken by an external force due to structural fragility of the glass tube. Furthermore, because a voltage more than 1 KV is used as a main power supply, an accident of electric shock may be undesirably caused.

In addition, to deform the conventional glass tube having a predetermined diameter, a part of the glass tube is heated to obtain a partially melted state. Thereafter, the glass tube is bent into a predetermined shape, thus forming the desired advertisement pattern.

Therefore, the advertisement pattern, which is represented by the glass tube used in the conventional neon sign, must be limited due to the predetermined diameter of the glass tube. That is, it is almost impossible to form a letter or a pattern of a size smaller than the predetermined diameter of the conventional glass tube. A size of the letter or pattern represented by the conventional glass tube is also limited.

In an effort to overcome the problems experienced in the conventional neon signs using the glass tubes, a luminous sign board was disclosed in U.S. Pat. No. 4,703,574. Although the luminous sign board disclosed in U.S. Pat. No. 4,703,574 provides a luminous sign board with a planar board shape, its structure is complex.

That is, to manufacture the conventional luminous sign board disclosed in U.S. Pat. No. 4,703,574, three sheets of plate material, which are a front transparent legend plate, a center feedthrough plate and a back crossover cavity plate, are provided. The three sheets are coupled to each other, so that a cavity is selectively provided between the three sheets to define a desired letter and pattern. In the above state, discharge electricity is induced in the cavity, thus representing the desired letter and pattern.

As such, the structure of the conventional luminous sign board disclosed in U.S. Pat. No. 4,703,574 is complex. Furthermore, because the conventional luminous sign board uses a back light source which is an indirect illumination technique, the fluorescent color of neon is deteriorated.

To solve the above-mentioned problems experienced in the conventional luminous sign, a neon sign device was proposed in Korean Patent Registration NO. 312613 (entitled: Neon sign device having plain shape and method for manufacturing the same). The conventional neon sign device disclosed in NO. 312613 has a thin construction in comparison with the conventional luminous sign board disclosed in U.S. Pat. No. 4,703,574. That is, the conventional neon sign device of NO. 312613 has a simple structure, thus reducing its size. Furthermore, the conventional neon sign device of NO. 312613 has the structure possible to represent finer letters and marks, withstand external forces, and prevent the electric shock from being undesirably caused.

The conventional neon sign device (hereinafter referred to as electric sign board) includes an upper glass substrate, with an electric discharge electrode provided on a lower surface of the upper glass substrate. The conventional electric sign board further includes a lower glass substrate which is attached to the lower surface of the upper glass substrate, with an electric discharge space to represent a predetermined advertisement pattern into a cavity.

That is, a basic technical spirit of the conventional electric sign board disclosed in NO. 312613 is that the electric discharge space is defined between the lower glass substrate and the upper glass substrate, so that electric discharge is generated in the electric discharge space using the electric discharge electrode which is a transparent electrode. The conventional electric sign board is a device of a P.D.P (plasma display panel) type, different from an LCD (liquid crystal display), which is a flat panel display. The conventional electric sign board has therein a fluorescent material and inert gas, so that the electric discharge is generated through the transparent electrode by discharge electricity.

As shown in FIGS. 1 and 2, the fluorescent material 2*b* is applied to a surface of the cavity 2*a*. Inert discharge gas G is injected into the cavity 2*a*. The cavity 2*a* is engraved on a predetermined portion of an upper surface of the lower glass substrate 2, for example, by an etching process.

The electric discharge electrode of the conventional electric sign board 10 comprises two transparent electrodes 1-1 and 2-1 and bus electrodes to supply the discharge electricity to the two transparent electrodes 1-1 and 2-1.

Referring to FIG. 3, a method of manufacturing the conventional electric sign board 10 having the plain shape includes step 100 of forming the electric discharge electrode on the upper glass substrate 1, and step 200 of forming on the lower glass substrate 2 the cavity 2*a* having a role as the electric discharge space and corresponding to the advertisement pattern. The method of manufacturing the conventional electric sign board 10 further includes step 300 of coupling the upper glass substrate 1 and the lower glass substrate 2 to each other.

Step 300 includes a providing an injection tip T which is made of a glass tube and communicates with the cavity 2*a* defined between the upper glass substrate 1 and the lower glass substrate 2 that are closely bonded together at step 302. The injection tip T is mounted on either side of the upper glass substrate 1 and the lower glass substrate 2. Preferably, the injection tip T is mounted on the lower glass substrate 2.

Substantially, the injection tip T is made integrally when the upper glass substrate 1 and the lower glass substrate 2 are attached to each other.

Step 300 further includes step 304 of injecting both the electric discharge gas and getter, which is high oxidative material and will be described later herein (in step 306), into the cavity 2*a* through the injection tip T.

For example, mixed gas of neon, zeon and helium can be injected to the cavity 24.

The mixed gas does not substantially give out any color upon electric discharge. When only ultraviolet rays are emitted by the electric discharge, the ultraviolet rays illuminate the fluorescent material coated and baked on the cavity 2*a*.

In the meantime, in step 304, after injecting a specific gas into the cavity 2*a*, the injection tip T to inject the gas into the cavity 2*a* is tipped off, as shown in FIG. 2.

Thereafter, the opened injection tip T is sealed through a melting process, thus maintaining the vacuum in the cavity 2*a*. In practice, to exhaust air from and inject the gas into the cavity 2*a*, the process of sealing the injection tip T is accomplished by melting and clogging both the injection tip T and a tubular body T1 in state in that the tubular body T1 is coupled to the injection tip T.

Thereafter, the completed conventional electric sign board 10 having the plain shape is assembled with its peripheral components before being practically mounted indoors or outdoors.

After the conventional electric sign board 10 is completed through the above-mentioned manufacturing process, an electrical current is applied to the electric discharge electrodes 1-1 and 2-1 to generate electric discharge between the electric discharge electrodes 1-1 and 2-1 which are exposed to each other.

By the ultraviolet rays emitted by the electric discharge, the fluorescent material 2*b*, which is applied on the surface of the cavity 2*a*, illuminates the advertisement pattern, such as letters or logos, defined by the cavity. Thus, a desired advertising effect is obtained.

However, in the conventional electric sign board 10 manufactured by the above-mentioned method, the injection tip T, which is made of the glass tube and communicates with the cavity 2*a* defined between the upper glass substrate 1 and the lower glass substrate 2 to inject the gas into the cavity 2*a* for the electric discharge, has following several problems.

First, the injection tip T, which is made of the same glass material as the lower glass substrate 2, is mounted to the lower glass substrate 2. Therefore, during the process of exhausting air from and injecting the gas into the cavity 2*a*, the injection tip T may be broken by interfering with a gas injection apparatus. In addition, after completing the process of injecting the gas into the cavity 2*a*, the injection tip T may be broken during the process of sealing the injection tip T or carrying the electric sign board 10.

As described above, the process of sealing the injection tip T is accomplished by melting the injection tip T and tipping off an unnecessary part from the injection tip T (at a melted portion of the injection tip T). At this time, a remaining part of the injection tip T is always projected from the lower surface of the lower glass substrate 2. Therefore, when the conventional electric sign board 10 along with other components is installed at a predetermined position, a space required to install the conventional electric sign board 10 is unexpectedly increased due to the projected part of the injection tip T. That is, the conventional electric sign board 10 with the injection tip T is limited in its installation space.

SUMMARY OF THE INVENTION

Accordingly, the present invention has been made keeping in mind the above problems occurring in the prior art, and an object of the present invention is to provide a plasma display panel and a method of manufacturing the same, which has a structure capable of directly injecting gas into and sealing the plasma display panel, without using any injection tip, thus reducing a thickness of the plasma display panel, reducing a space required to install the plasma display panel in a frame of a neon sign, and avoiding damages, caused by conventional injection tips, while carrying the plasma display panel.

In an aspect, the present invention provides a method of manufacturing a plasma display panel without any injection tip, including providing a lower glass substrate, with an electrical discharge cell provided on an upper surface of the lower glass substrate to define a predetermined display pattern of the plasma display panel, a fluorescent material applied on a surface of the electrical discharge cell, and a first transparent electrode having a high conductivity and provided on a lower surface of the lower glass substrate; providing an injection hole on a predetermined portion of the lower glass substrate to exhaust air from and inject inert gas into the electrical discharge cell through the injection hole; attaching an upper glass substrate on the upper surface of the lower glass substrate using a sealing line, with a second transparent electrode having a high conductivity and provided on a lower surface of the upper glass substrate; injecting the inert gas into the electrical discharge cell of the lower glass substrate using a vacuum apparatus through the injection hole while the air is exhausted from the electrical discharge cell to an outside of the plasma display panel by the vacuum apparatus through the injection hole, thus creating a vacuum in the electrical discharge cell; placing a sealing material on a lower end of the injection hole to seal the injection hole; and hardening the sealing material placed on the lower end of the injection hole by exposing the sealing material to ultraviolet rays, thus maintaining the vacuum in the electrical discharge cell.

In another aspect, the present invention provides a vacuum apparatus used in a method of manufacturing a plasma display panel without any injection tip, including: a barrel part having a cylindrical shape, having a seating groove provided on a first end of the barrel part to seat therein a first ring, an actuating hole downward extending from the upper end of the barrel part to a predetermined depth, and at least one light transmitting hole provided on a predetermined portion of an outer surface of the barrel part; a guide part integrally extending from a second end of the barrel part, having a guide hole axially extending in a central part of the guide part to communicate with the actuating hole of the barrel part, an external thread provided on an outer surface of the guide part, with a second ring fitted over the external thread of the guide part, and a gate provided on a predetermined portion of the outer surface of the guide part to exhaust air from and feed gas to an interior of a plasma display panel, thus creating a vacuum in the plasma display panel; an actuating rod control part having an internal thread provided on a predetermined portion of the actuating rod control part to engage with the external thread of the guide part, and a sliding hole axially extending from an end of the guide hole of the guide part to a predetermined depth, with an end of the sliding hole being closed; an actuating rod having a predetermined length to slide in the sliding hole of the actuating rod control part, with a magnet provided on an end of the actuating rod, a magnetic ring fitted over the actuating rod control part to magnetically control the actuating rod; and a transparent tubular body fitted over the barrel part from the guide part, and sealed at a junction between the transparent tubular body and the barrel part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
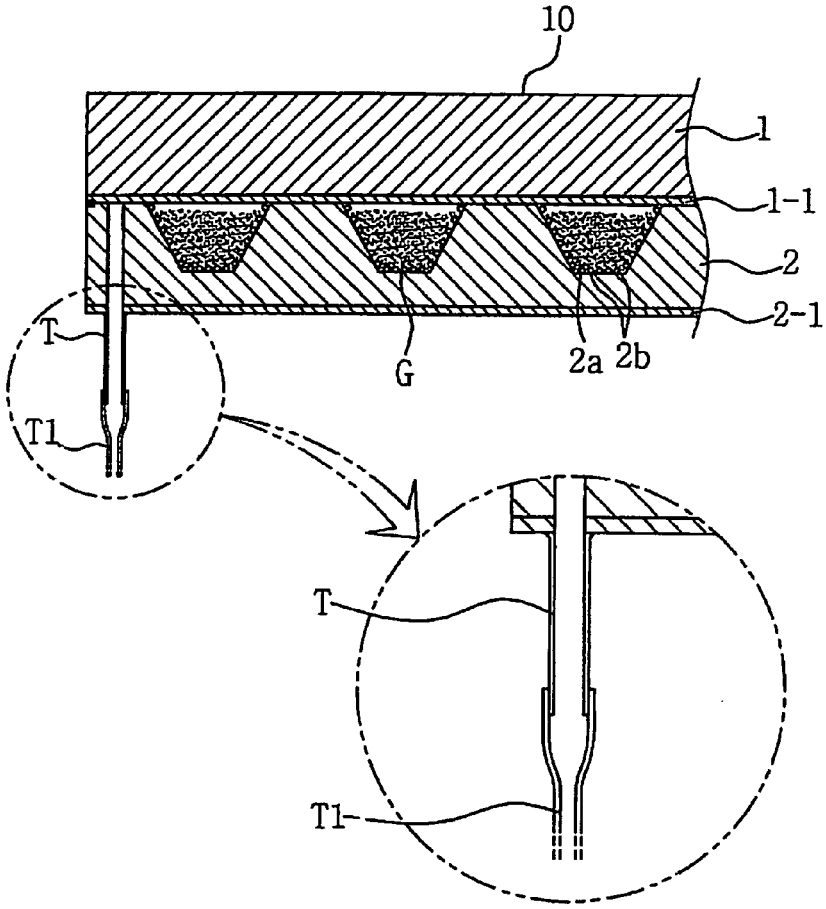
FIG. 1 Prior Art
FIG. 1 is a sectional view of a conventional plasma display panel having an injection tip to exhaust air from and inject gas into the plasma display panel.
Figure 2:
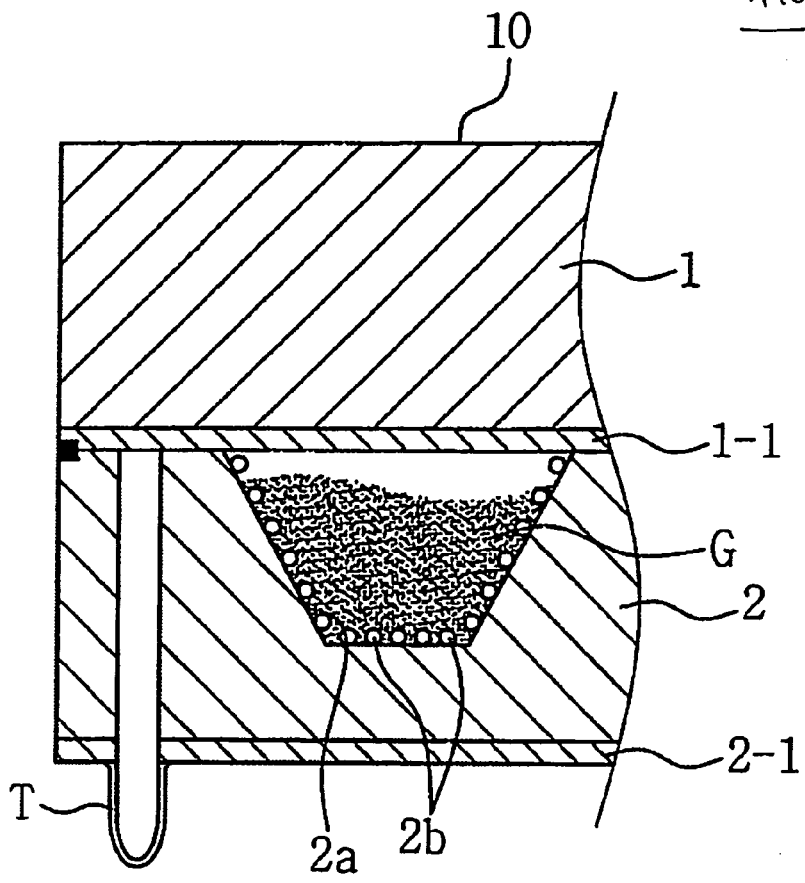
FIG. 2 Prior Art
FIG. 2 is a partially enlarged view showing a part of the conventional plasma display panel of FIG. 1, which shows the injection tip tipped off and sealed.
Figure 3:
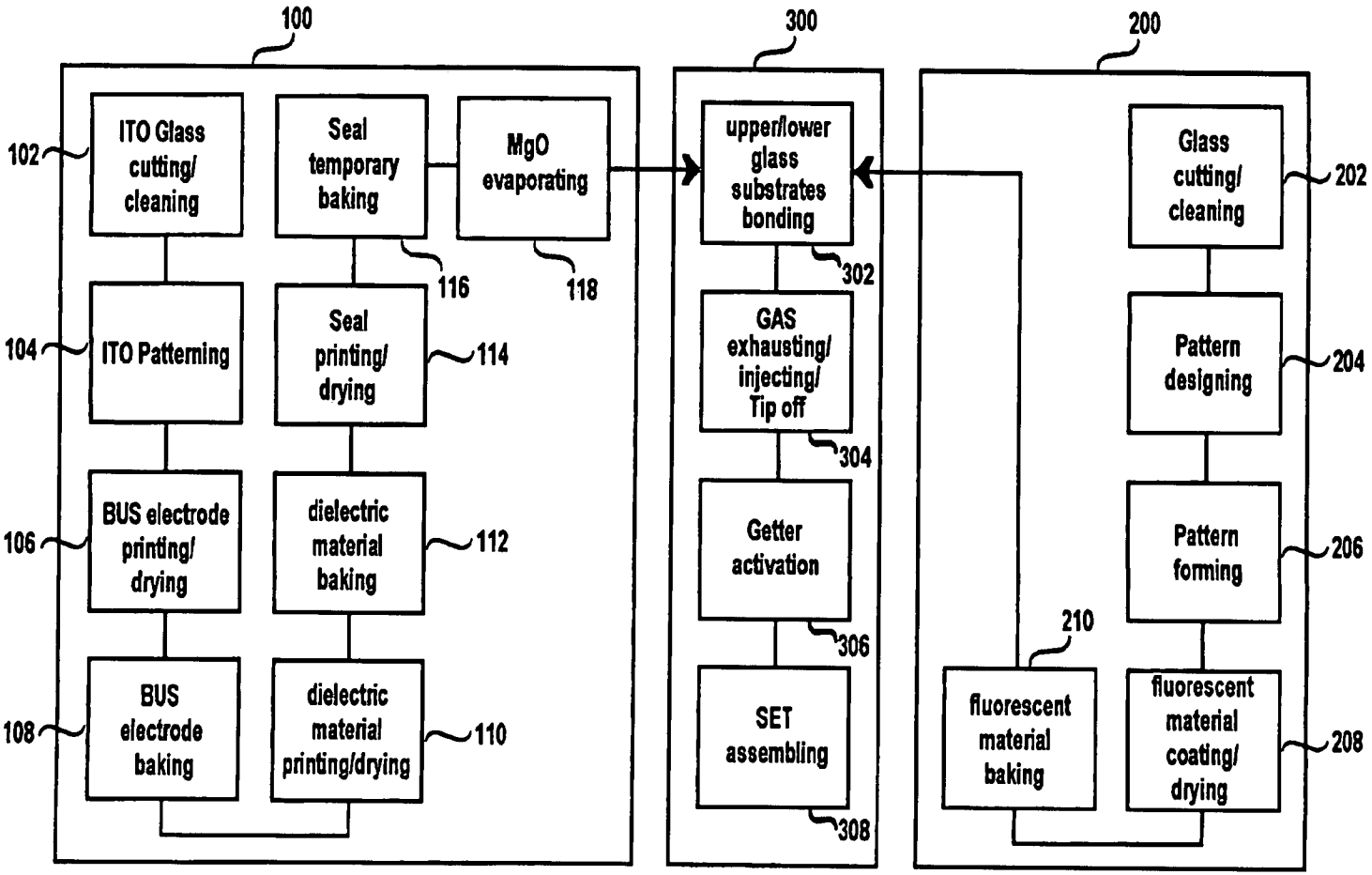
Prior Art FIG. 3
FIG. 3 is a block diagram showing a method of manufacturing the conventional plasma display panel of FIG. 1.

Hereinafter, embodiments of the present invention will be described in detail with reference to the attached drawings.

Reference now should be made to the drawings, in which the same reference numerals are used throughout the different drawings to designate the same or similar components.

Figure 4:
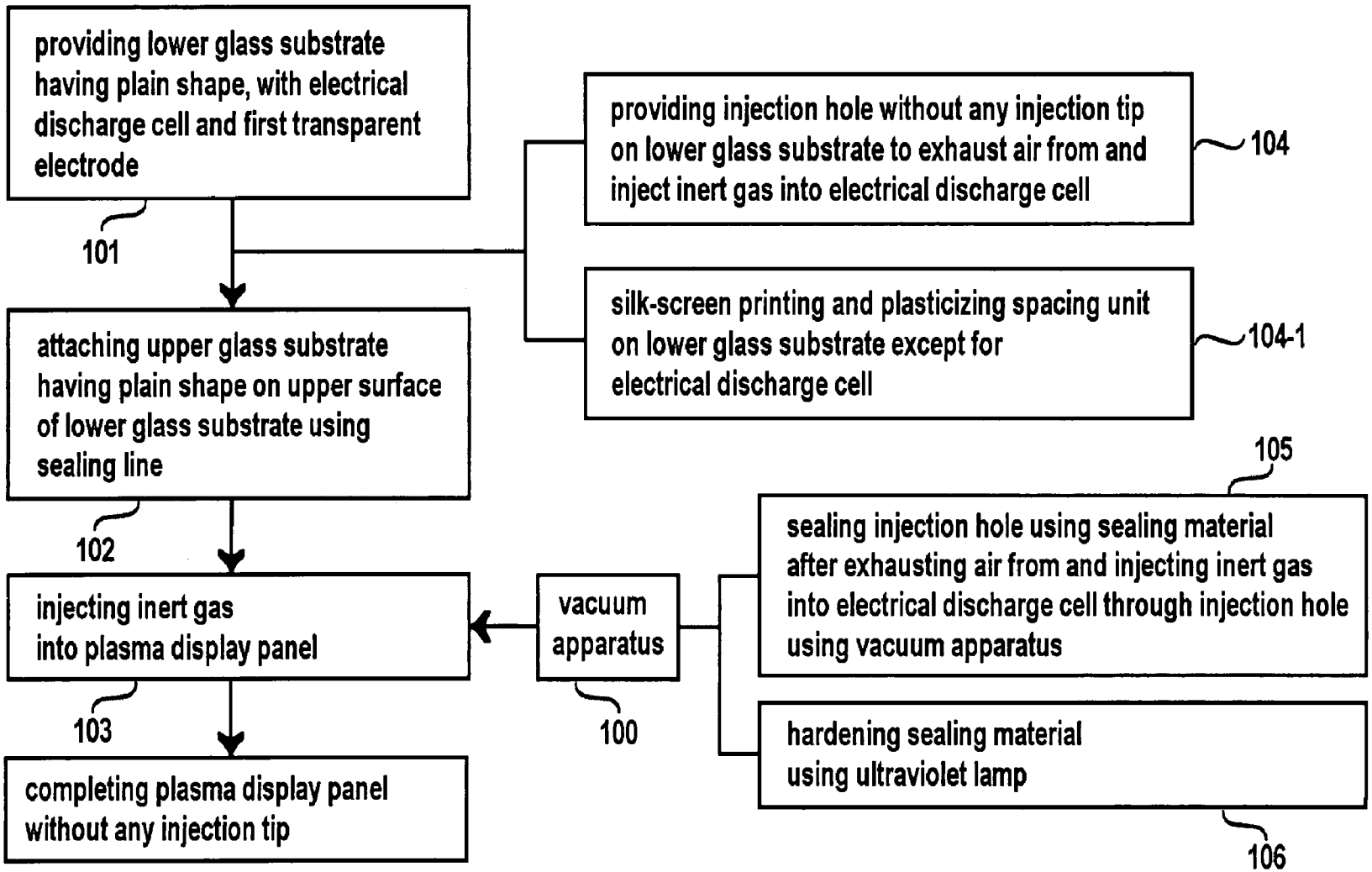
FIG. 4 is a block diagram showing a process of manufacturing a plasma display panel, according to an embodiment of the present invention.

FIG. 4 is a block diagram showing a process of manufacturing a plasma display panel 10, according to an embodiment of the present invention. Referring to FIG. 4, in a method of manufacturing the plasma display panel 10 of the present invention, a lower glass substrate 2 is provided at step S101, with an electrical discharge cell 2*a* provided on an upper surface of the lower glass substrate 2 to define a predetermined display pattern of the plasma display panel 10, a fluorescent material 2*b* applied on a surface of the electrical discharge cell 2*a*, and a first transparent electrode 2*c* having a high conductivity and provided on a lower surface of the lower glass substrate 2. Thereafter, an upper glass substrate 1 is attached on the upper surface of the lower glass substrate 2 using a sealing line 1*b* at step S102, with a second transparent electrode 1*a* having a high conductivity and provided on a lower surface of the upper glass substrate 1. Inert gas G is, thereafter, injected into the electric discharge cell 2 of the lower glass substrate 2 at step S103. Before the upper glass substrate 1 is attached on the upper surface of the lower glass substrate 2, an injection hole 2*d* is provided on a predetermined portion of the lower glass substrate 2 at step S104 to exhaust air from and inject the inert gas G into the electrical discharge cell 2*a* through the injection hole 2*d*.

After exhausting the air from and injecting the inert gas G into the electrical discharge cell 2 of the lower glass substrate 2 through the injection hole 2*d* of the lower glass substrate 2 using a vacuum apparatus 100 to create the vacuum in the electrical discharge cell 2*a*, a sealing material E is placed on a lower end of the injection hole 2*d* to seal the injection hole 2*d* at step S105.

Thereafter, the sealing material E, placed on the lower end of the injection hole 2*d*, is hardened by exposing the sealing material E to ultraviolet rays at step S106, thus maintaining the vacuum in the electrical discharge cell 2*a*.

Furthermore, in the method of manufacturing the plasma display panel 10 of the present invention, a spacing unit 2*e* is silk-screen printed on the upper surface of the lower glass substrate 2 except for the electrical discharge cell 2*a* at step S104-1 during step S104 of the providing of the injection hole 2*d* on the predetermined portion of the lower glass substrate 2. Thus, an upper end of the injection hole 2*d* neighboring to the lower surface of the upper glass substrate 1 is spaced apart from the lower surface of the upper glass substrate 1.

The plasma display panel 10 without any injection tip according to the present invention is produced through the above-mentioned manufacturing method.

In the plasma display panel 10 of the present invention, the sealing material E to seal the injection hole 2*d* of the lower glass substrate 2 preferably comprises an epoxy resin of an ultraviolet-hardened type.

Figure 5:
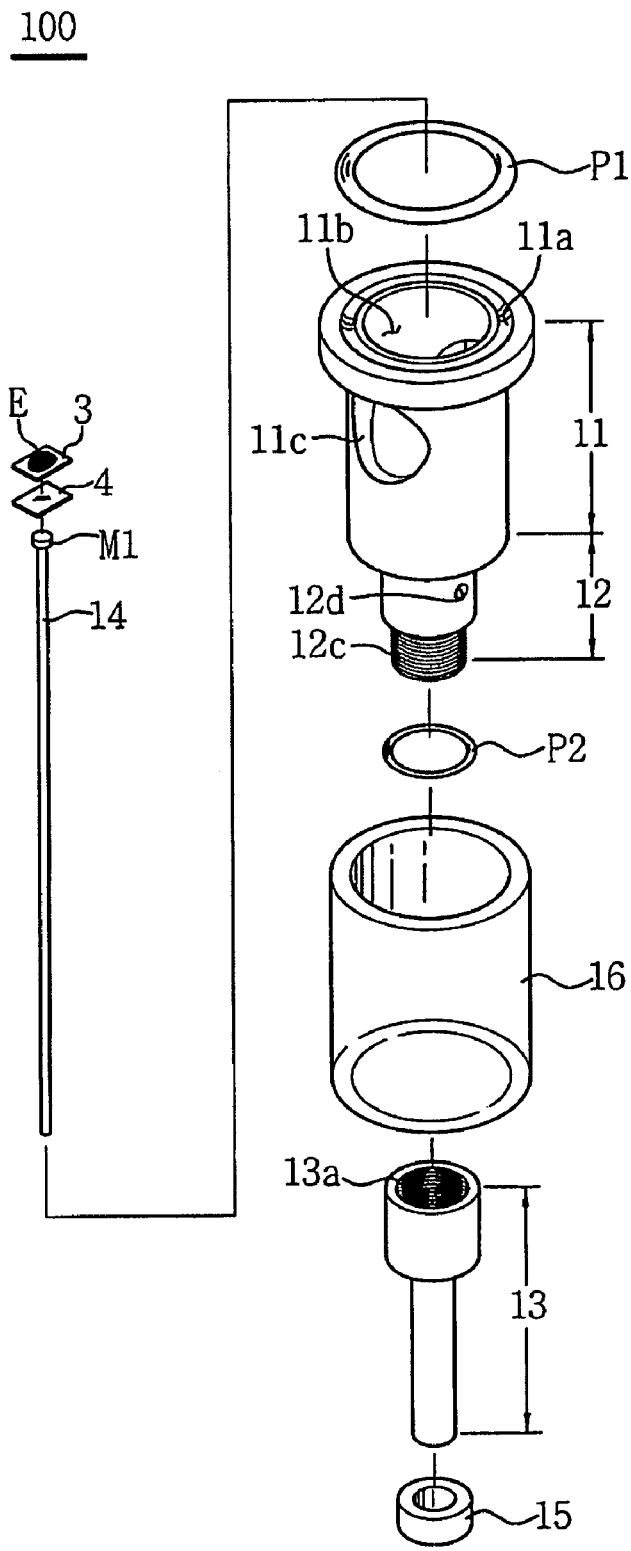
FIG. 5 is an exploded perspective view of a vacuum apparatus used in the method of manufacturing the plasma display panel shown in FIG. 4.
Figure 6:
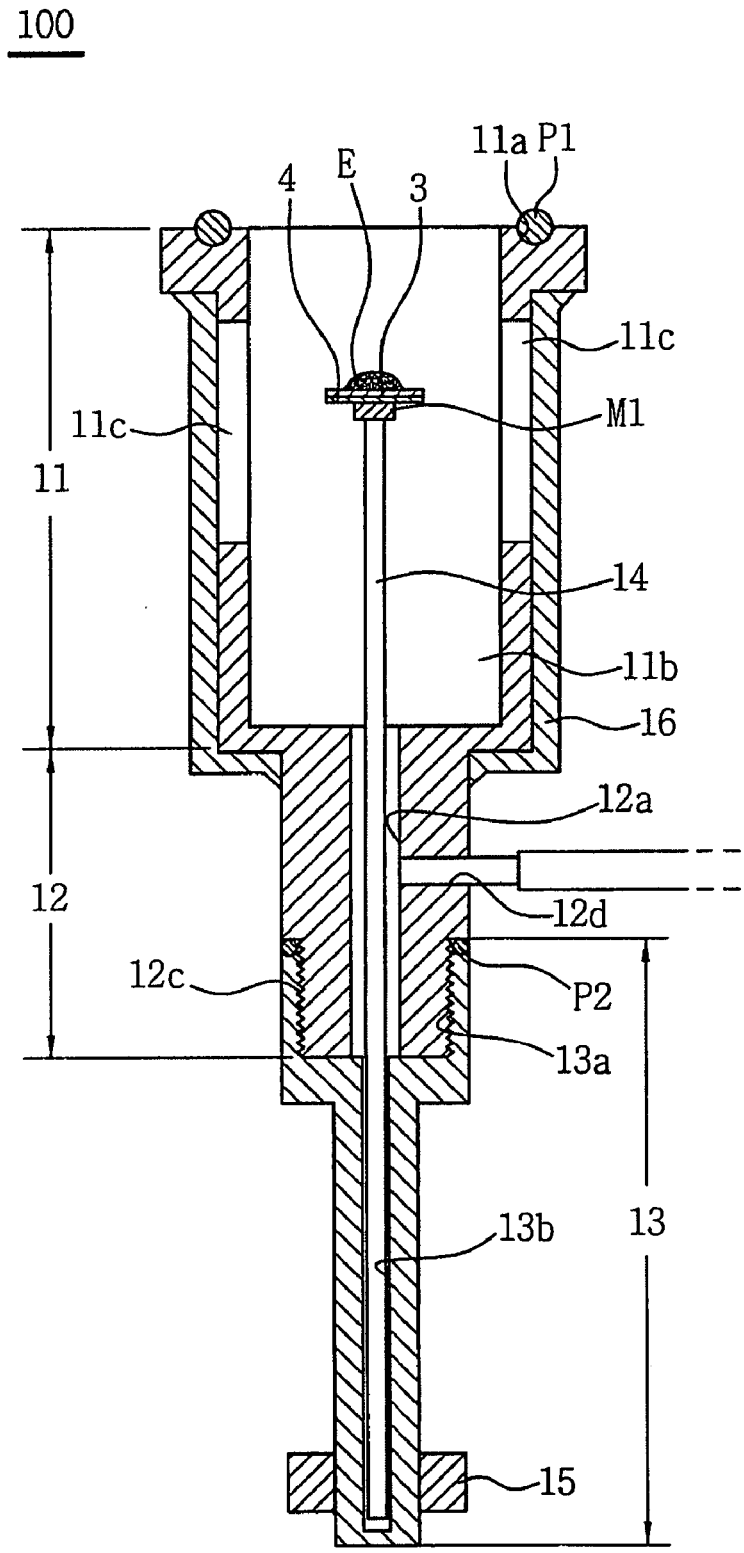
FIG. 6 is a longitudinal sectional view of the vacuum apparatus of FIG. 5.

FIG. 5 is an exploded perspective view of the vacuum apparatus 100 used in the method of the manufacturing the plasma display panel 100 of the present invention. FIG. 6 is a longitudinal sectional view of the vacuum apparatus of FIG. 5. The vacuum apparatus 100 used in the method of the manufacturing the plasma display panel 100 according to the present invention includes a barrel part 11 having a cylindrical shape. The barrel part 11 has a seating groove 11*a* which is provided on a first end of the barrel part 11 to seat therein a first ring P1, and an actuating hole lib which downward extends from the first end of the barrel part 11 to a predetermined depth. The barrel part 11 further has at least one light transmitting hole 11*c* which is provided on a predetermined portion of an outer surface of the barrel part 11. The vacuum apparatus 100 further includes a guide part 12 which integrally extends from a second end of the barrel part 11. The guide part 12 has a guide hole 12*a* which axially extends in a central part of the guide part 12 to communicate with the actuating hole 11*b* of the barrel part 11, and an external thread 12*c* which is provided on an outer surface of the guide part 12, with a second ring P2 fitted over the external thread 12*c* of the guide part 12. The guide part 12 further has a gate 12*d* which is provided on a predetermined portion of the outer surface of the guide part 12 to exhaust air from and feed gas into an interior of the plasma display panel 10, thus creating the vacuum in the plasma display panel 10. The vacuum apparatus 100 further includes an actuating rod control part 13. The actuating rod control part 13 has an internal thread 13*a* which is provided on a predetermined portion of the actuating rod control part 13 to engage with the external thread 12*c* of the guide part 12, and a sliding hole 13*b* which axially extends from an end of the guide hole 12*a* of the guide part 12 to a predetermined depth, with an end of the sliding hole 13*b* being closed. The vacuum apparatus 100 further includes an actuating rod 14 which has a predetermined length and slides in the sliding hole 13*b* of the actuating rod control part 13, with a magnet M1 provided on an end of the actuating rod 14. The vacuum apparatus 100 further includes a magnetic ring 15 which is fitted over the actuating rod control part 13 to magnetically control the actuating rod 14. The vacuum apparatus 100 further includes a transparent tubular body 16 which is fitted over the barrel part 11 from the guide part 12 and is sealed at a junction between the transparent tubular body 16 and the barrel part 11.

The transparent tubular body 16 comprises a silica glass tube to transmit light emitted from an ultraviolet lamp 17 into the barrel part 11, thus hardening the sealing material E which is placed on the lower end of the injection hole 2*d*. Preferably, the transparent tubular body 16 is firmly sealed at the junction between the barrel part 11 and the transparent tubular body 16 to allow the vacuum apparatus 100 to exhaust air from and inject the gas into the plasma display panel 10, and thereby maintain the vacuum in the plasma display panel 10.

The plasma display panel 10 of the present invention may further include the ultraviolet lamp 17 which is provided at a predetermined position of an outside of the barrel part 11 to be spaced apart from the outer surface of the barrel part 11 having the light transmitting hole 11*c*, thus hardening the sealing material E, seated on the actuating rod 14, using ultraviolet rays.

The ultraviolet lamp 17 is mounted such that the light beam emitted from the ultraviolet lamp 17 is inclined relative to the light transmitting hole 11*c* of the barrel part 11 at a predetermined angle. Preferably, as the plasma display panel 10 according to the embodiment of the present invention, an additional ultraviolet lamp 17-1 is provided above the upper glass substrate 1. Thus, the additional ultraviolet lamp 17-1 emits the ultraviolet rays to the sealing material E through the injection hole 2*d*, thus hardening a part of the sealing material E which entered into the injection hole 2*d* of the lower glass substrate 2.

The vacuum apparatus 100 further includes a metal plate 3 which has a predetermined diameter larger than a diameter of the injection hole 2*d* to cover the injection hole 2*d* and is provided on a first end of the actuating rod 14. The metal plate 3 seats thereon the predetermined amount of the sealing material E to seal the injection hole 2*d* of the lower glass substrate 2 of the plasma display panel 10 without any injection tip. A resin plate 4 is temporarily attached to a second surface of the metal plate 3 opposite to a first surface of the metal plate 3 on which the sealing material E is seated.

The metal plate 3 is magnetically attached to the magnet M1 which is provided on the end of the actuating rod 14. The resin plate 4 is a thin plate to separate the metal plate 3 from the magnet M1 of the actuating rod 14 when necessary.

For reference, the upper glass substrate 1 and the lower glass substrate 2 to define an appearance of the plasma display panel 10 are produced by a basic technique. That is, initial glass working and cleaning processes, a drying process, a dielectric plasticizing process, a getter injecting process, an electric discharge cell etching process and a voltage drive process are executed in the same manner as that used in manufacturing conventional plasma display panels, and further explanation is thus not deemed necessary.

The operation and effect of the plasma display panel 10 without any injection tip and method of manufacturing the same according to the present invention will be described herein below.

First, step S102, in which the upper glass substrate 1 is attached on the upper surface of the lower glass substrate 2 on which the electric discharge cell 2*a* applied with the fluorescent material 2*b* is provided, is executed.

At this time, the upper glass substrate 1 is attached on the lower glass substrate 2 by plasticizing the sealing line 1*b* which is provided in the junction of the upper glass substrate 1 and the lower glass substrate 2.

The upper end of the injection hole 2*d* to exhaust the air from and inject the gas into the plasma display panel 10 is spaced apart from the lower surface of the upper glass substrate 1 by the spacing unit 2*e*, silk-screen printed on the upper surface of the lower glass substrate 2 except for the electrical discharge cell 2*a*, while the upper glass substrate 1 is attached on the upper surface of the lower glass substrate 2.

The spacing unit 2*e* is a liquid-phase dielectric material which is made by Daejoo Fine Chemical Co., Ltd of Korea. The spacing unit 2*e* is made of a frit which is a solution in which an ethyl cellulose resin as a binder and a butyl carbitol acetate (BCA) as a solvent are included in a lead glass (PbO).

The above-mentioned liquid-phase dielectric material is silk-screen printed on the upper surface of the lower glass substrate 2. Thereafter, the liquid-phase dielectric material is plasticized under a high-temperature of 500~600° C. for 30 minutes to 1 hour, thus forming the spacing unit 2*e* to be projected from the upper surface of the lower glass substrate 2.

By the spacing unit 2*e*, the lower surface of the upper glass substrate 1 is spaced apart from the upper surface of the lower glass substrate 2. Therefore, the spacing unit 2*e* provides a plurality of flow paths between the upper glass substrate 1 and the lower glass substrate 2, while the vacuum apparatus 100 exhausts the air from and injects the gas into the plasma display panel 10. Thus, process time of exhausting the air from and injecting the gas into the plasma display panel 10 is reduced, so that the productivity of products is enhanced.

The spacing unit 2*e* is provided while silk-screen printing the frit on the upper surface of the lower glass substrate 2 in a predetermined pattern and plasticizing the frit. Typically, the predetermined pattern of the spacing unit 2*e* is defined as a shape different from an advertisement letter or mark designed on the plasma display panel 10, thus increasing the advertising efficiency of the plasma display panel 10.

In the meantime, the lower end of the injection hole 2*d* is leveled with the lower surface of the lower glass substrate 2. That is, the plasma display panel 10 of the present invention does not have any injection tip, different from a conventional plasma display panel having the injection tip to inject the gas into the conventional plasma display panel and maintain the vacuum. In the plasma display panel 10 of the present invention, the vacuum apparatus 100 exhausts the air from and inject the gas into the plasma display panel 10 through the injection hole 2*d* of the lower glass substrate 2 without any injection tip.

In the plasma display panel 10 without any injection tip, the injection hole 2*d* of the lower glass substrate 2 is directly sealed by the vacuum apparatus 100 which injects the inert gas for the electric discharge into the plasma display panel 10, thus maintaining the vacuum.

The process of sealing the injection hole 2*d* using the vacuum apparatus 100 will be described in detail in the following, with reference to FIGS. 6 through 8.

Before creating the vacuum in the plasma display panel 10, the sealing material E, which is the epoxy resin of the ultraviolet-hardened type, is seated on the end of the actuating rod 14 which is provided in the barrel part 11 (see, FIG. 6).

That is, the magnet M1 having a predetermined size to correspond to a diameter of the actuating rod 14 is attached on the end of the actuating rod 14. The sealing material E is seated on the metal plate 3 which is magnetically attached on the magnet M1.

Because the resin plate 4 is attached to the second surface of the metal plate 3, the metal plate 3 is indirectly attached to the magnet M1. Thus, the actuating rod 14 is smoothly removed from both the metal plate 3 and the resin plate 4 after the process of sealing the injection hole 2*d*.

Figure 7:
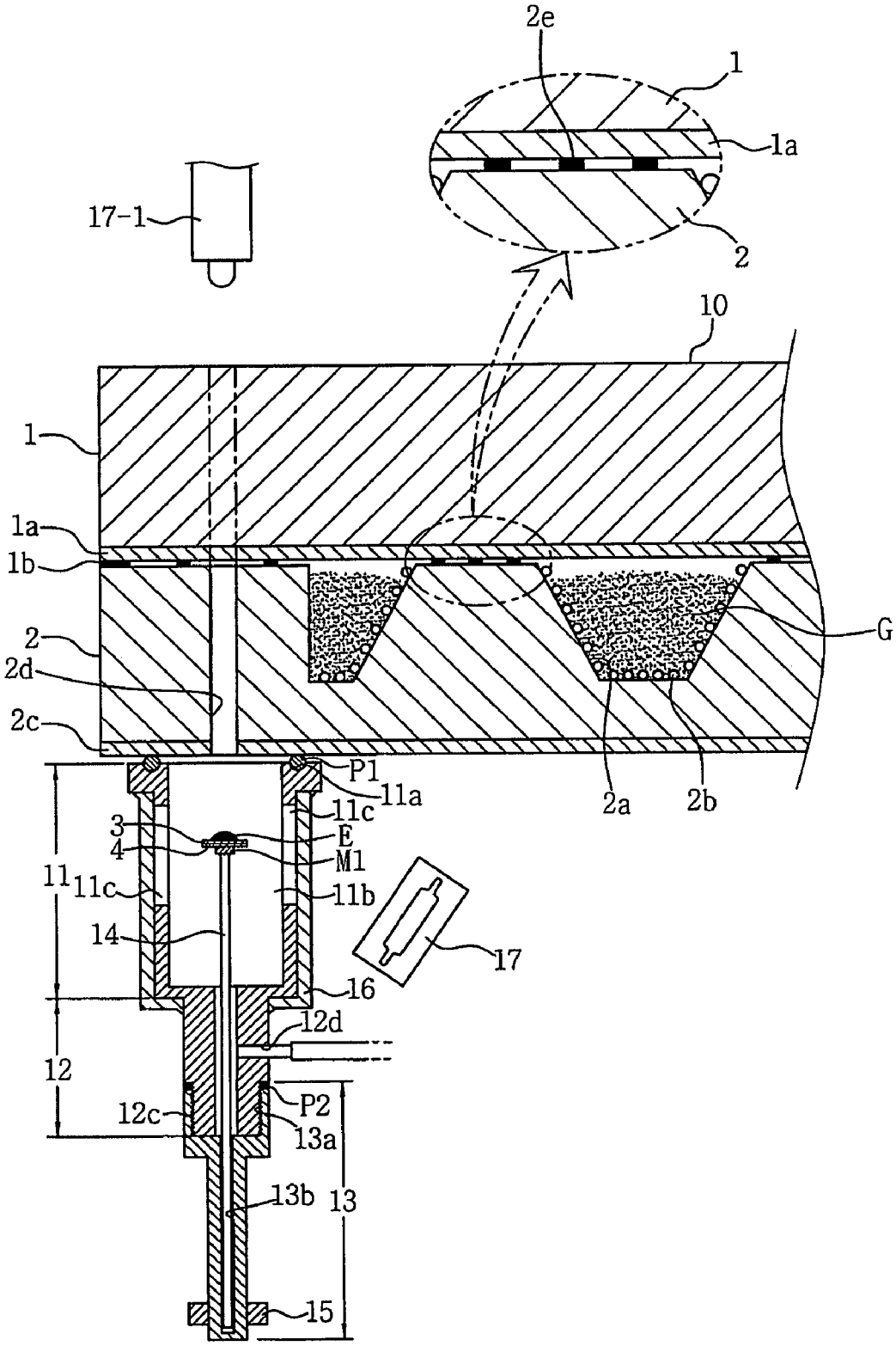
FIG. 7 is a sectional view showing an operation of the vacuum apparatus of FIG. 5, in which the vacuum apparatus is placed around an injection hole of the plasma display panel to exhaust air from and inject inert gas into the plasma display panel through the injection hole.

After the sealing material E is seated on the metal plate 3 of the actuating rod 14, the first end of the barrel part 11 is in close contact with the lower surface of the lower glass substrate 2 around the injection hole 2*d*, as shown in FIG. 7. That is, while a worker places the vacuum apparatus 100 around the injection hole 2*d* of the lower glass substrate 2, a junction between the vacuum apparatus 100 and the lower glass substrate 2 is sealed by the first ring P1 which is seated in the seating groove 11*a*.

In the above state, the air is exhausted from the plasma display panel 10 through the gate 12*d* of the guide part 12 which integrally extends from the barrel part 11. Thereafter, the inert gas G (mixed gas: neon, zeon and helium) for the electric discharge is injected into the plasma display panel 10 through the gate 12*d*.

For reference, the gate 12*d* is coupled to a predetermined pipe which is connected to a motor pump (not shown), thus creating the vacuum in the plasma display panel 10.

The inert gas G, which is injected into the plasma display panel 10, is filled in both the electric discharge cell 2*a* (the advertisement pattern) applied with the fluorescent material 2*b* and a space which is defined between the upper glass substrate 1 and the lower glass substrate 2 by the spacing unit 2*e*.

Figure 8:
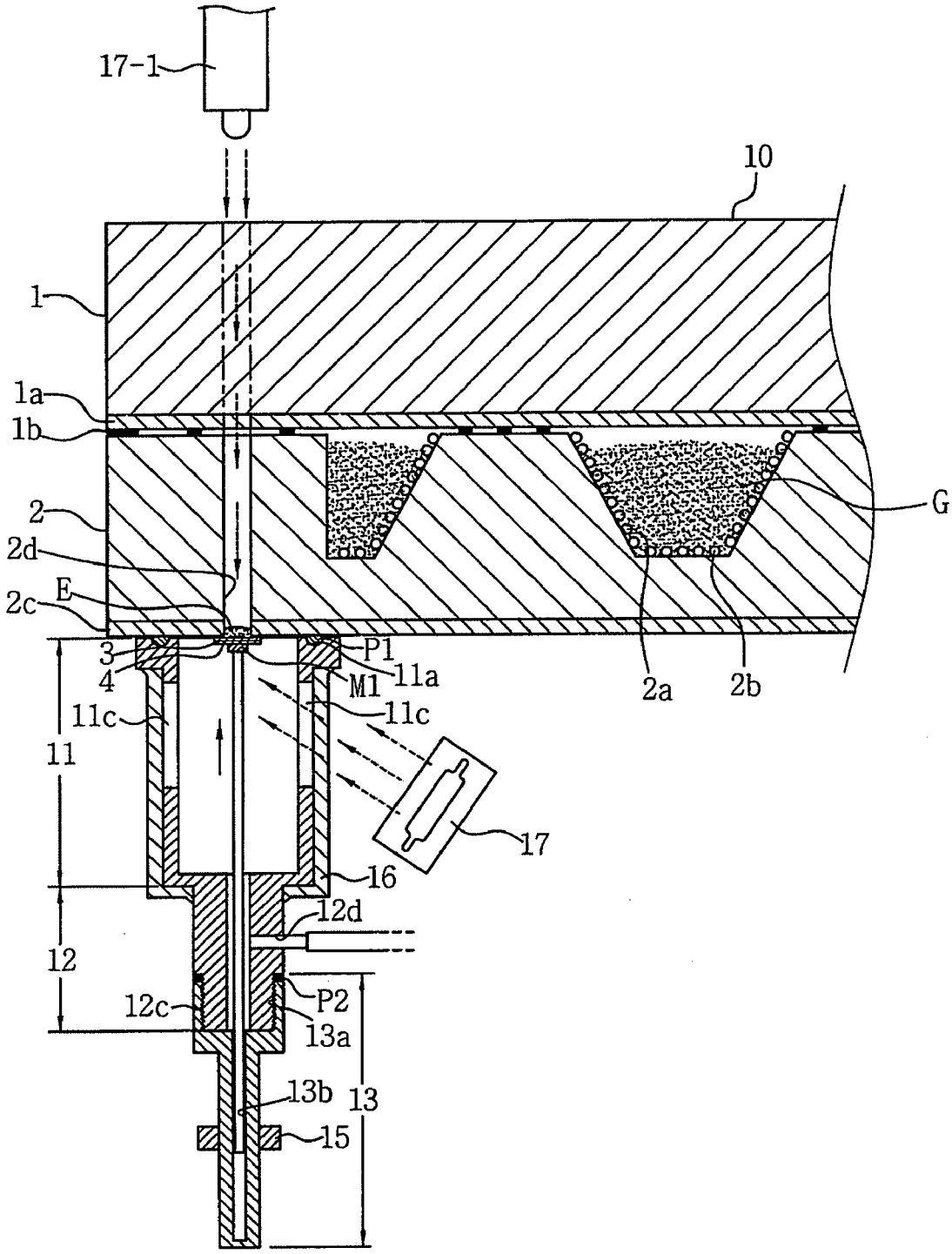
FIG. 8 is another sectional view showing the operation of the vacuum apparatus of FIG. 5, in which a sealing material of the vacuum apparatus, placed on a lower end of the injection hole to seal the injection hole, is hardened by being exposed to ultraviolet rays emitted from an ultraviolet lamp.
Figure 9:
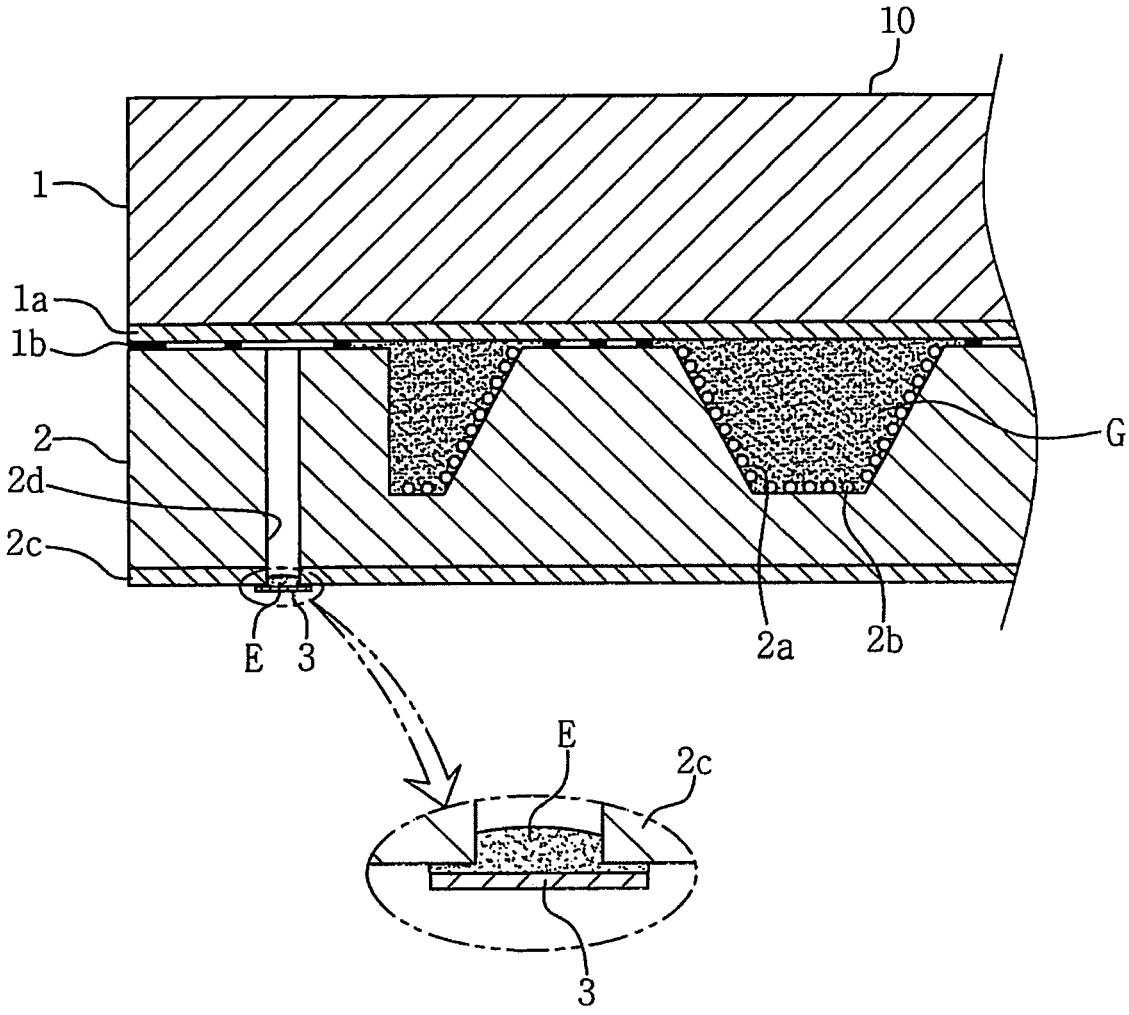
FIG. 9 is a partially enlarged sectional view showing a part of the plasma display panel manufactured by the manufacturing process shown in FIG. 4, in which the injection hole is sealed by the sealing material without using any injection tip.

In the above state in that the vacuum is maintained in the plasma display panel 10, the actuating rod 14 holding the sealing material E is moved to the lower end of the injection hole 2*d* while the magnetic ring 15 slides from a second end to a first end of the actuating rod control part 13 which is coupled to the guide part 12, as shown in FIG. 8. Therefore, the sealing material E, moved along with the actuating rod 14, is placed on the lower end of the injection hole 2*d* to seal the injection hole 2*d*.

To execute the above-mentioned operation of the actuating rod 14, the magnetic ring 15 is fitted over the outer surface of the actuating rod control part 13. When the magnetic ring 15 slides along the outer surface of the actuating rod control part 13, the actuating rod 14, placed in the actuating rod control part 13, magnetically slides along with the magnetic ring 15.

The sliding hole 13*b* has a diameter to correspond to the diameter of the actuating rod 14, so that the actuating rod 14 is moved vertically without being undesirably played.

The actuating rod 14 is moved along the sliding hole 13*b*, the guide hole 12*b* of the guide part 12, and the barrel part 11 while maintaining the vacuum in the vacuum apparatus 100.

That is, the barrel part 11 is sealed at a junction between the first end of the barrel part 11 and the lower glass substrate 2 by the first ring P1. The transparent tubular body 16, fitted over the barrel part 11, is also sealed at the junction between the transparent tubular body 16 and the barrel part 11. A junction between the guide part 12 and the actuating rod control part 13 is sealed by the second ring P2, fitted over the external thread of the guide part 12, while the external thread of the guide part 12 engages with the internal thread of the actuating rod control part 13.

In the above state, the predetermined amount of the sealing material E on both the metal plate 3 and the resin plate 4 is placed at the lower end of the injection hole 2*d*, while the actuating rod 14 is magnetically moved upward by the magnetic ring 15. Thus, the sealing material E on the metal plate 3 completely closes the injection hole 2*d*.

While the actuating rod 14 is forced upward, the sealing material E, which comprises the epoxy resin of the ultraviolet-hardened type, is exposed for 30 seconds to the light emitted from the ultraviolet lamp 17 which is mounted to be inclined relative to the light transmitting hole 11*c* of the barrel part 11 at the predetermined angle.

The ultraviolet lamp 17 emits light to the sealing material E through the transparent tubular body 16, fitted over the barrel part 11, thus hastening the hardening of the sealing material E.

As shown in the drawings, the additional ultraviolet lamp 17-1 is provided above the upper glass substrate 1. Therefore, the additional ultraviolet lamp 17-1 emits light to the part of the sealing material E, which entered into the injection hole 2*d*, through the upper glass substrate 1 and the injection hole 2*d* of the lower glass substrate 2. Thus, the sealing material E is quickly hardened at the lower end of the injection hole 2*d*.

As described above, the injection hole 2*d* of the lower glass substrate 2 is sealed by using the vacuum apparatus 100. That is, the sealing material E is hardened at the lower end of the injection hole 2*d*, and, simultaneously, the metal plate 3 is attached to the lower end of the injection hole 2*d*. Therefore, the injection hole 2*d* is sealed without using any injection tip, different from the conventional plasma display panels. Thus, the plasma display panel 10 of the present invention accomplishes the recent trend of thiness.

Due to the above-mentioned advantage, the plasma display panel 10 without any injection tip is advantageous in that it is easy to provide a space to install the plasma display panel 10. Furthermore, the plasma display panel 10 solves the problems that the injection tip of the conventional plasma display panel may be broken during a process of transporting or handling the conventional plasma display panel.

After the injection hole 2*d* is sealed by using the vacuum apparatus 100, a discharge current is supplied to the plasma display panel 10 through the first and second transparent electrodes 2*c* and 1*a*. Thereafter, the fluorescent material 2*b*, applied on the surface of the electrical discharge cell 2*a*, starts the electric discharge with the inert gas (mixed gas) which is filled in the vacuum plasma display panel 10. Thus, the fluorescent material 2*b* illuminates the desired advertisement pattern defined by the electric discharge cell 2*a*.

As described above, the present invention provides a plasma display panel which has a structure capable of directly injecting gas for an electric discharge into the plasma display panel without using any injection tip through an injection hole of a lower glass substrate using a vacuum apparatus while manufacturing the plasma display panel, thus sealing the plasma display panel in the vacuum. Therefore, the plasma display panel without any injection tip reduces a thickness thereof, thus a space required to install the plasma display panel is easily provided.

Furthermore, the plasma display panel without any injection tip avoids damages, caused by the injection tip of a conventional plasma display panel, during a process of transporting or installing the plasma display panel.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a plasma display panel without any injection tip, comprising:

providing a lower glass substrate, with an electrical discharge cell provided on an upper surface of the lower glass substrate to define a predetermined display pattern of the plasma display panel, a fluorescent material applied on a surface of the electrical discharge cell, and a first transparent electrode having a high conductivity and provided on a lower surface of the lower glass substrate;

providing an injection hole on a predetermined portion of the lower glass substrate to exhaust air from and inject inert gas into the electrical discharge cell through the injection hole;

attaching an upper glass substrate on the upper surface of the lower glass substrate using a sealing line, with a second transparent electrode having a high conductivity and provided on a lower surface of the upper glass substrate;

injecting the inert gas into the electrical discharge cell of the lower glass substrate using a vacuum apparatus through the injection hole while the air is exhausted from the electrical discharge cell to an outside of the plasma display panel by the vacuum apparatus through the injection hole, thus creating a vacuum in the electrical discharge cell;

placing a sealing material on a lower end of the injection hole to seal the injection hole; and hardening the sealing material placed on the lower end of the injection hole by exposing the sealing material to ultraviolet rays, thus maintaining the vacuum in the electrical discharge cell.

2. The method according to claim 1, wherein the sealing material comprises an epoxy resin of an ultraviolet-hardened type.

3. The method according to claim 1, further comprising:

silk-screen printing a spacing unit made of a glass frit on the upper surface of the lower glass substrate except for the electrical discharge cell and plasticizing the spacing unit during the providing of the injection hole on the predetermined portion of the lower glass substrate, thus spacing an upper end of the injection hole neighboring to the lower surface of the upper glass substrate apart from the lower surface of the upper glass substrate.

* * * * *